US006669616B1

(12) United States Patent
Bierenacki et al.

(10) Patent No.: US 6,669,616 B1
(45) Date of Patent: Dec. 30, 2003

(54) COMPACT CASE FORMING MACHINE

(75) Inventors: Wojciech Bierenacki, South Canaan, PA (US); William Menta, West Wyoming, PA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/669,935

(22) Filed: Sep. 26, 2000

(51) Int. Cl.[7] ..... B31B 1/80
(52) U.S. Cl. ..... 493/316; 493/309
(58) Field of Search ..... 493/316, 183, 493/181, 122, 126, 309; 53/458, 564

(56) References Cited

U.S. PATENT DOCUMENTS

| | | | | |
|---|---|---|---|---|
| 3,420,036 A | | 1/1969 | Hutchinson | |
| 3,443,357 A | | 5/1969 | Bacon et al. | |
| 3,451,318 A | | 6/1969 | Arnaudon et al. | |
| 3,739,696 A | | 6/1973 | Pearson | |
| 4,081,945 A | | 4/1978 | Calvert et al. | |
| 4,285,682 A | | 8/1981 | Moss | |
| 4,348,853 A | | 9/1982 | Morse et al. | |
| 4,414,789 A | | 11/1983 | Pattarozzi | |
| 4,627,830 A | | 12/1986 | Smidt | |
| 4,854,111 A | | 8/1989 | Roberts et al. | |
| 4,857,038 A | | 8/1989 | Tacchini | |
| 4,915,678 A | | 4/1990 | Morita | |
| 4,930,291 A | | 6/1990 | Boisseau | |
| 5,024,640 A | | 6/1991 | Saitoh | |
| 5,106,359 A | | 4/1992 | Lott | |
| 5,127,894 A | * | 7/1992 | Maccaferri | 493/316 |
| 5,393,291 A | | 2/1995 | Wingerter | |
| 5,713,187 A | * | 2/1998 | Peterson | 493/316 |
| 5,924,968 A | * | 7/1999 | Odenthal | 493/126 |
| 6,070,396 A | | 6/2000 | Rinaldi et al. | |
| 6,266,948 B1 | * | 7/2001 | Serra | 493/316 |

FOREIGN PATENT DOCUMENTS

| | | |
|---|---|---|
| DE | 2155230 | 5/1973 |
| FR | 2616748 | 12/1988 |
| GB | 1441760 | 7/1976 |

* cited by examiner

*Primary Examiner*—Eugene Kim
*Assistant Examiner*—Sameh H. Tawfik
(74) *Attorney, Agent, or Firm*—Donald J. Breh; Mark W. Croll; Lisa M. Soltis

(57) ABSTRACT

A case forming machine for assembling erected cases from blanks including a stacking means configured for receiving a supply of blanks, an opening and forming means for erecting the blanks and ejecting erected cases, and the machine is constructed and arranged so that the stacking means is configured for biasing the supply of blanks in a first direction and the forming means is configured so that the blanks are ejected in a second direction. The machine also includes a frame, a stacking apparatus for holding a supply of blanks, an opening and forming apparatus, a vertical blank guide configured to advance the supply of blanks in a first direction, a vertical blank mover for transporting blanks from the stacking apparatus to the opening and forming apparatus, a first minor flap folder and a second minor flap folder, a first major flap folder and a second major flap folder; and a case advancement mechanism attached to the opening and forming apparatus, the case advancement mechanism configured to advance cases in a second direction along the opening and forming apparatus.

17 Claims, 3 Drawing Sheets

COMPACT CASE FORMING MACHINE

BACKGROUND OF THE INVENTION

The present invention relates to a box or case forming machine, and more particularly relates to a case forming machine for use where limited floor space is available.

Case forming machines are commonly used for assembling erected cases from flat blanks. Generally, flat blanks are stacked within a stacking apparatus, or hopper, which in turn feeds the blanks to an assembling deck. An assembling apparatus opens the blank to form an open quadrilateral tube, and subsequently closes and seals the bottom flaps. The erected case is then ejected from the machine, ready for use, such as filling with manufactured products. These cases are central to the packaging, shipping and storing needs of commercial enterprises. However, conventional case forming machines are relatively large; and their footprints can consequently consume large areas of valuable floor space in plants, factories, store rooms, and/or other areas in businesses which utilize these machines.

Another disadvantage of conventional case forming machines is that they are frequently powered by electrical motors and, as a consequence, are disruptively loud. Often, these larger case formers are not cost efficient because they are expensively built for high volume output which exceeds the needs of smaller businesses.

Smaller case forming machines are known in the art, wherein the hopper or stacking apparatus is positioned either adjacent to the deck and assembly apparatus, or is vertically displaced from the deck and assembly apparatus. However, while these machines are smaller in size compared to conventional case forming machines, neither orientation provides a minimal footprint. For example, U.S. Pat. No. 5,393,291 (Wingerter) represents a typical case forming machine. The hopper is positioned adjacent to a case forming deck. Gravity fed, vertically oriented blanks are opened directly from the hopper by a case puller arm that raises out of the assembly deck, grips the blank, and retracts back into the deck, opening the blanks. The hopper is mounted above the ground, but because the hopper feeds the blank onto the deck in the same direction in which the finished product is ejected, the machine still consumes an undue amount of space.

U.S. Pat. No. 4,915,678 (Morita) discloses a case forming machine having a similar problem. Morita teaches a hopper positioned adjacent to and above the deck and assembly apparatus, which is further inclined in the direction of the deck and assembly apparatus so that the blanks are gravity fed. This still causes undue consumption of overhead space.

It is an object of the present invention to provide an improved case forming machine having low output volume, which also minimizes consumption of floor and overhead space.

It is another object of the present invention to provide an improved case forming machine that is quiet and operates simply at slow speed.

SUMMARY OF THE INVENTION

The above-listed objects are met or exceeded by the present case forming machine, featuring a stacking apparatus configured to orient blanks in a first direction and an opening and forming apparatus configured to eject formed cases in a second direction. The present case forming machine contains a stacking apparatus biased in the first direction by a vertical blank guide mounted to a chain assembly. Blanks are transported vertically to the opening and forming apparatus by a vertical blank mover. The opening and forming apparatus is coupled to a pneumatic cable cylinder and includes a vacuum arm for opening the blanks and a case advancement mechanism to advance cases in the second direction. The stacking apparatus and opening and forming apparatus and vertically displaced from one another and generally parallel to one another, so that the overall configuration of the machine is a generally sideways U-shape.

More specifically, the present invention provides a case forming machine including a stacking apparatus configured for receiving a supply of blanks, and an opening and forming apparatus for erecting the blanks and ejecting erected cases. The machine is constructed and arranged so that the stacking apparatus is configured for biasing the supply of blanks in a first direction and the opening and forming apparatus is configured so that the blanks are ejected in a second direction.

DESCRIPTION OF THE PREFERRED EMBODIMENT

Figure 1:
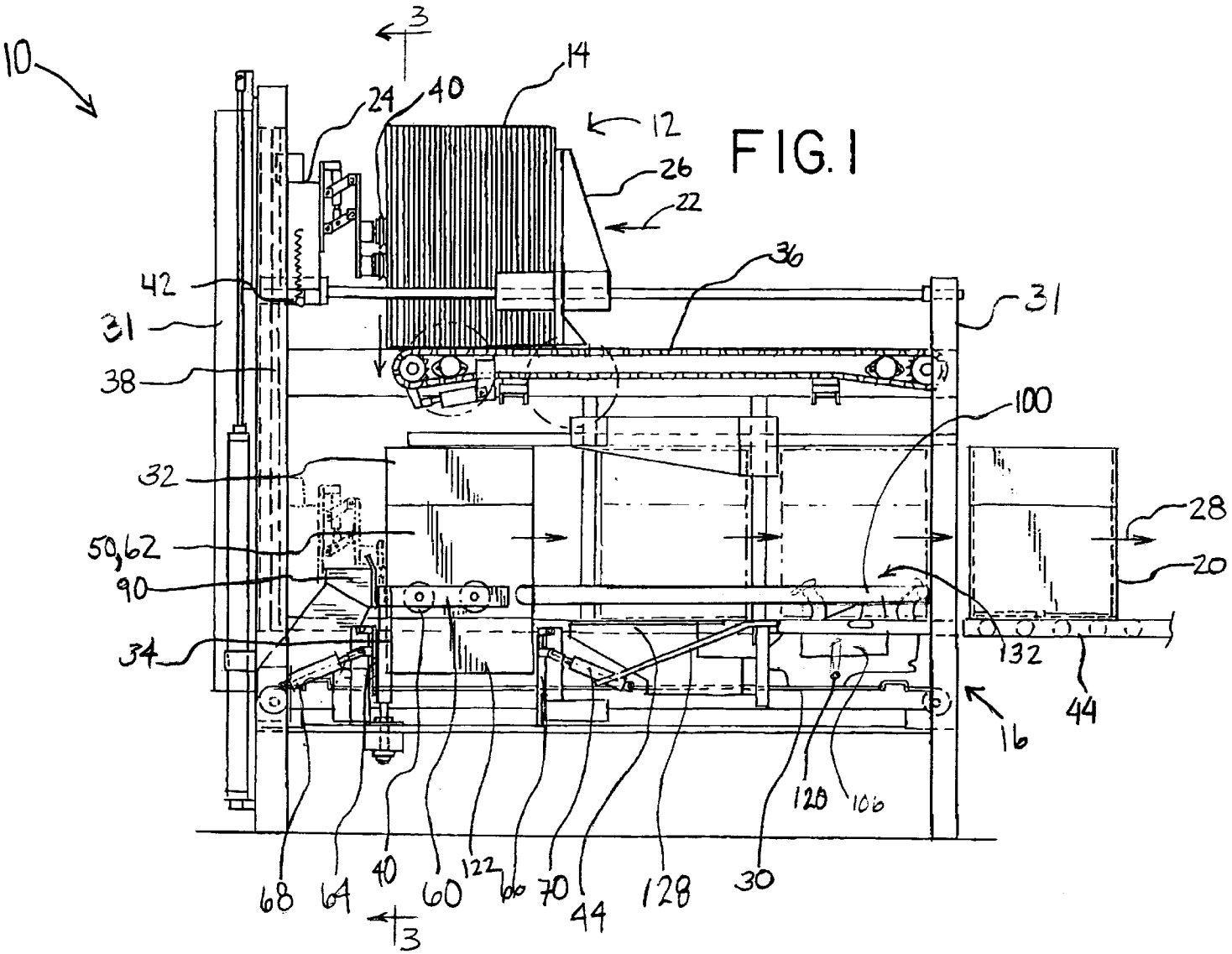
FIG. 1 is a side elevational view of the preferred embodiment of the present case forming machine.

Referring now to FIG. 1, the preferred embodiment of the present case forming machine is generally designated as 10. The machine 10 includes a stacking apparatus 12, or hopper, configured for receiving a supply of blanks, or collapsed cases, 14, and an opening and forming apparatus 16 for erecting the blanks into formed cases 20 and ejecting the formed cases. The stacking apparatus 12 is biased in a first direction 22 toward a vertical blank mover 24 by a vertical blank guide 26, and the opening and forming apparatus 16 is biased in a second direction 28 by a pneumatic cable cylinder 30. It is also contemplated that other fluid powered cylinders, such as hydraulic cylinders, could also be employed.

The stacking apparatus 12 is vertically displaced from the opening and case forming apparatus 16, and the generally rectangular dimensions of each are generally aligned to be parallel with one another. In this way, the stacking apparatus 12 is stacked on top of the opening and forming apparatus 16 to form a generally sideways U-shaped frame 31.

In the preferred embodiment, the supply of blanks 14 is vertically stacked in the stacking apparatus 12, with upper flaps 32 open toward the ceiling and lower flaps 34 open toward the ground. The drive for the stacking apparatus 12 is a standard stacking apparatus drive known to one of ordinary skill in the art. For example, the hopper assembly for a conventional case forming machine, Little David® Model CF-40T, manufactured by Loveshaw, South Canaan, Pa., employs this type of drive system. The stacking apparatus 12 includes the vertically-oriented biasing member, or vertical blank guide 26, which orients the supply of blanks 14 vertically. The vertical blank guide 26 is driven on a chain assembly 36, which advances the supply of blanks 14 in increments equal to the width of one unassembled blank in the first direction 22.

The vertical blank mover 24, which is preferably a vacuum arm mounted to a vertical track 38 and contains a plurality of vacuum cups 40, secures and vertically transports a blank 14 from the stacking apparatus 12 to the opening and forming apparatus 16. The vertical blank mover 24 is vertically disposed between the stacking apparatus 12 and the opening and forming means 16. A limit switch 42, disposed adjacent to the vertical blank mover 24, monitors the removal of a single blank 14 from the stacking apparatus 12, and signals the vertical blank guide 26 to consequently advance the supply of blanks 14 each by an increment of one blank thickness in the first direction 22.

The vertical blank mover 24 pulls a blank 14 downward from the stacking apparatus 12 to the opening and forming apparatus 16. A feature of the present invention is that neither the orientation nor the configuration of the blank 14 is altered during transport. The blanks 14 in both the stacking apparatus 12 and within the opening and forming apparatus 16 have two sides.

Figure 2:
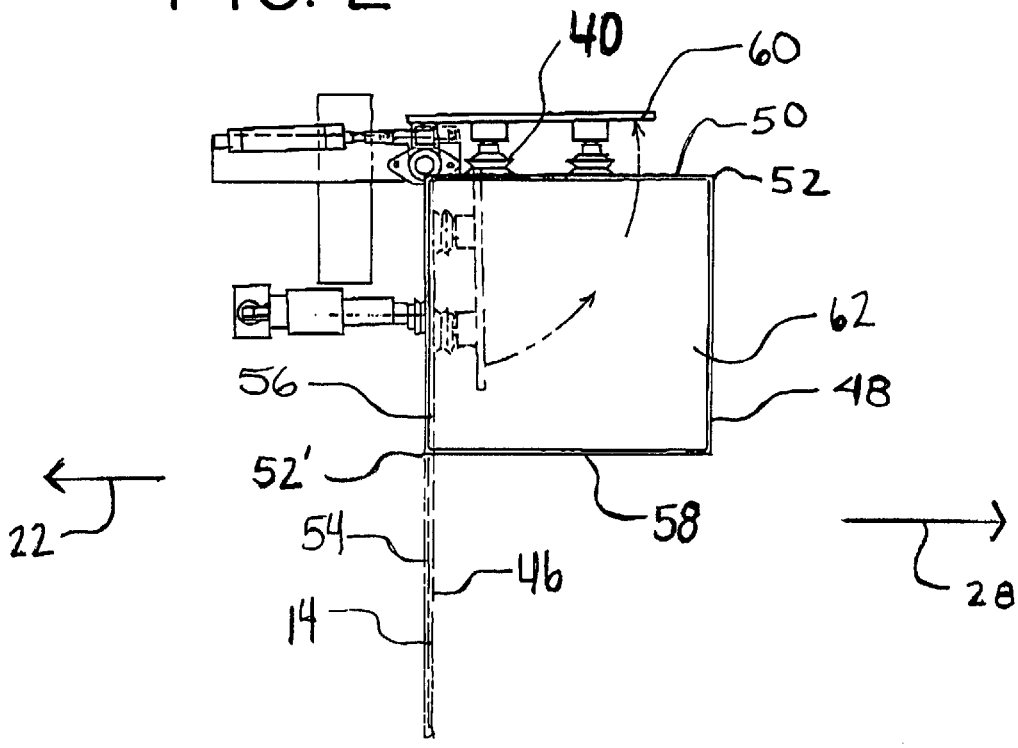
FIG. 2 is an overhead plan view of the present case opening apparatus.
Figure 5:
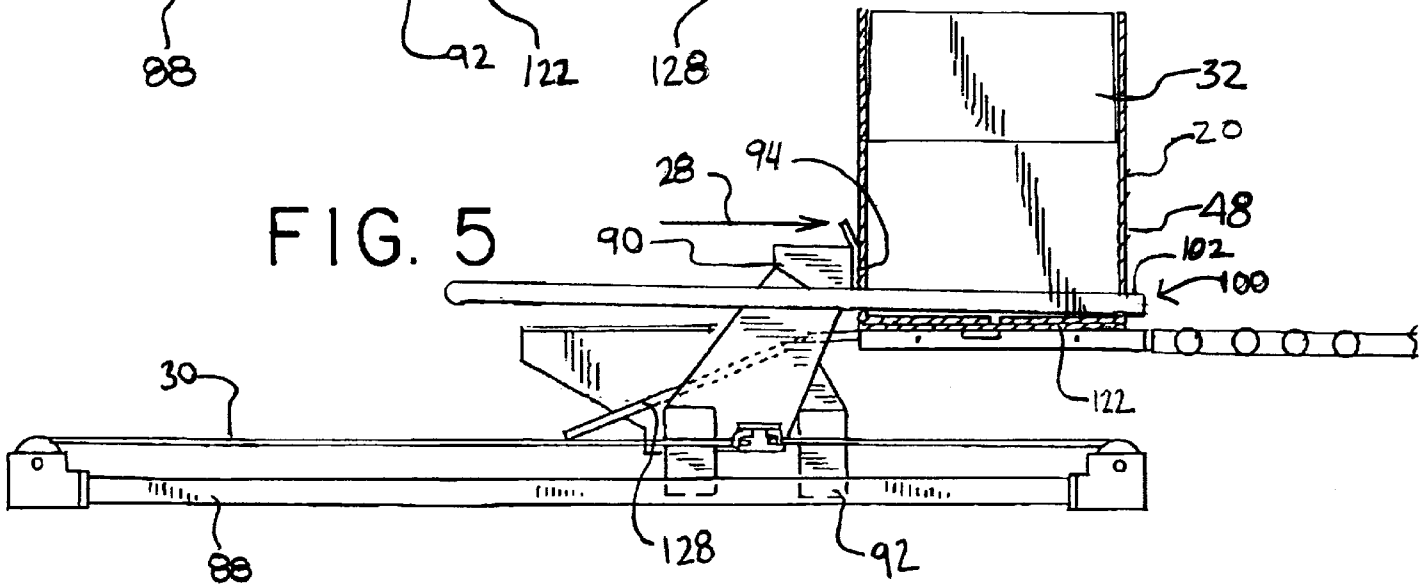
FIG. 5 is a fragmentary side elevational view of the machine of FIG. 1 showing a later case forming step than shown in FIG. 4.

As depicted in FIG. 2, when viewed from above, a first side 46 of the blank 14 faces the second direction 28, and contains the leading case face 48 and the first case side 50, continuous with one another and divided by a score 52 which will later form a corner of the erected case 20 (FIG. 5). A second side 54 of the blank faces the first direction 22, and contains the lagging case face 56 and the second case side 58, continuous with one another and divided by a score 52' which will later form a second corner of the erected case 20.

While in the stacking apparatus 12, and during its transport to the opening and forming apparatus 16, the first side 46 of the blank 18 is maintained in an orientation toward the second direction 28. Likewise, the second side 54 of the blank 14 is maintained in its orientation in the first direction 22 in the stacking apparatus 12 and during its transport to the opening and forming apparatus 16. This is advantageous in that less space is required for the transport of the blanks 14, and complex movements during transport are eliminated. Furthermore, the blanks 14 can be aligned and arranged within the stacking apparatus 12 and subsequently transported to the opening and forming apparatus 16 without disrupting the arrangement or alignment of the blanks.

Figure 3:
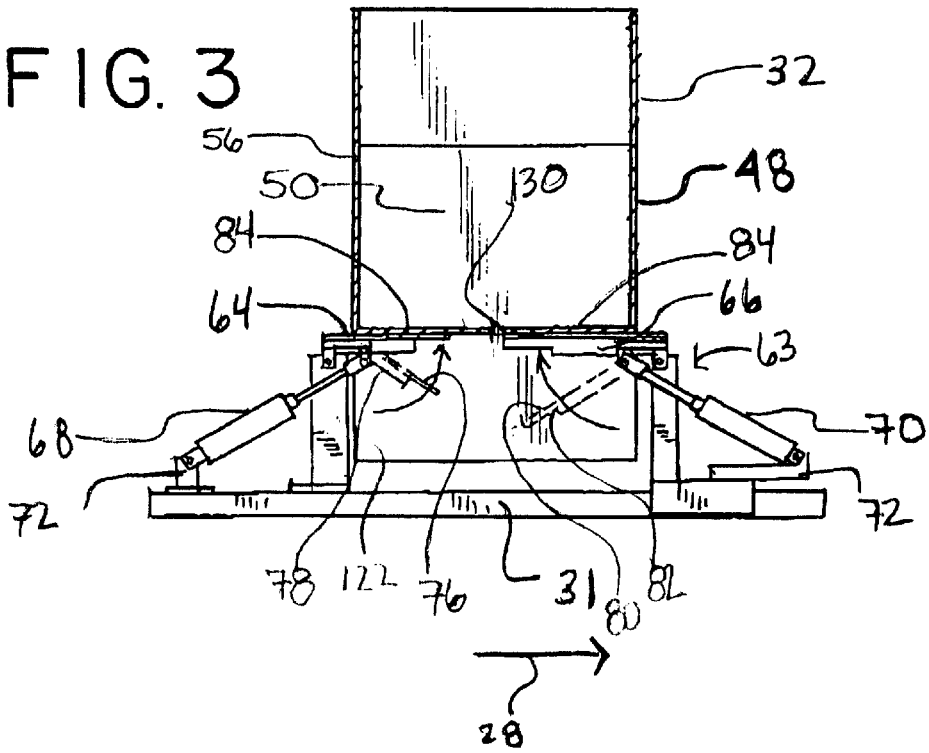
FIG. 3 is a sectional view taken along the line 3—3 of FIG. 1 and in the direction generally indicated.

In the preferred embodiment, the opening and forming apparatus 16 is conventional and commonly known to one of ordinary skill in the art. For example, a suitable opening and forming apparatus 16 is found in the Little David® Model CF-40T case former manufactured by Loveshaw of New Canaan, Pa. As depicted in FIGS. 2 and 3, at least one vacuum arm 60 pivots toward the blank 14. Ideally, the vacuum arm 60 contains one or more vacuum cups 40. When the vacuum arm 60 contacts the first case side 50 of the blank 14, the arm 60 is energized to create a vacuum bond between the blank 14 and the vacuum cups 40. Subsequently, the vacuum arm 60 pivots back to its original position, causing the blank 14 to open into an open-ended case 20. The leading case face 48 of the open case 20 now faces the second direction 28, and the lagging case face 56 of the open case faces the first direction 22.

Referring now to FIG. 3, once the blank 14 is in the open position, a minor flap folding apparatus, generally designated 63, is activated and consists of a first minor flap folder 64 and a second minor flap folder 66. The flap folders 64, 66 are also standard and well known to those skilled in the art. Again, for example, a commercially available case forming machine, the Little David® Model CF-40T, utilizes a suitable minor flap folding device. In the preferred embodiment, the minor flap folders 64, 66 are pneumatic devices, with first and second folding cylinders 68, 70 respectively, fixedly mounted to a base portion 72 of the frame 31 of the case forming machine 10. However, other known fluid powered cylinders, such as hydraulic cylinders, are contemplated.

The first and second minor flap folders 64, 66 are opposing hinged structures. More specifically, the first minor flap folder 64 has a top surface 76 and a bottom surface 78, and the second minor flap folder 66 likewise has a top surface 80 and a bottom surface 82. The minor flap folders 64, 66 depend vertically when they have not been activated, having the first top surface 76 parallel to, horizontally displaced from, and facing the second top surface 80. When activated, the folding cylinders 68, 70 extend to push the flaps 84 upward approximately 90°, so that the first minor flap folder 64 and the second minor flap folder 66 are generally planar with each other, and parallel to the opening and forming apparatus 16. This upward arcuate motion causes the minor flap folders 64, 66 to contact the minor flaps 84 of the case 20, and exert a force which closes the minor flaps.

Once the minor flaps 84 have been closed, the vacuum cups 40 on both the vertical blank mover 24 and the case opening vacuum arm 60 are deactivated. This deactivation allows the vertical blank mover 24 to return to its original position and the case opening vacuum arm 60 rotates away from the opened case 20. In turn, the horizontal blank mover assembly, designated generally at 86, is energized.

Figure 4:
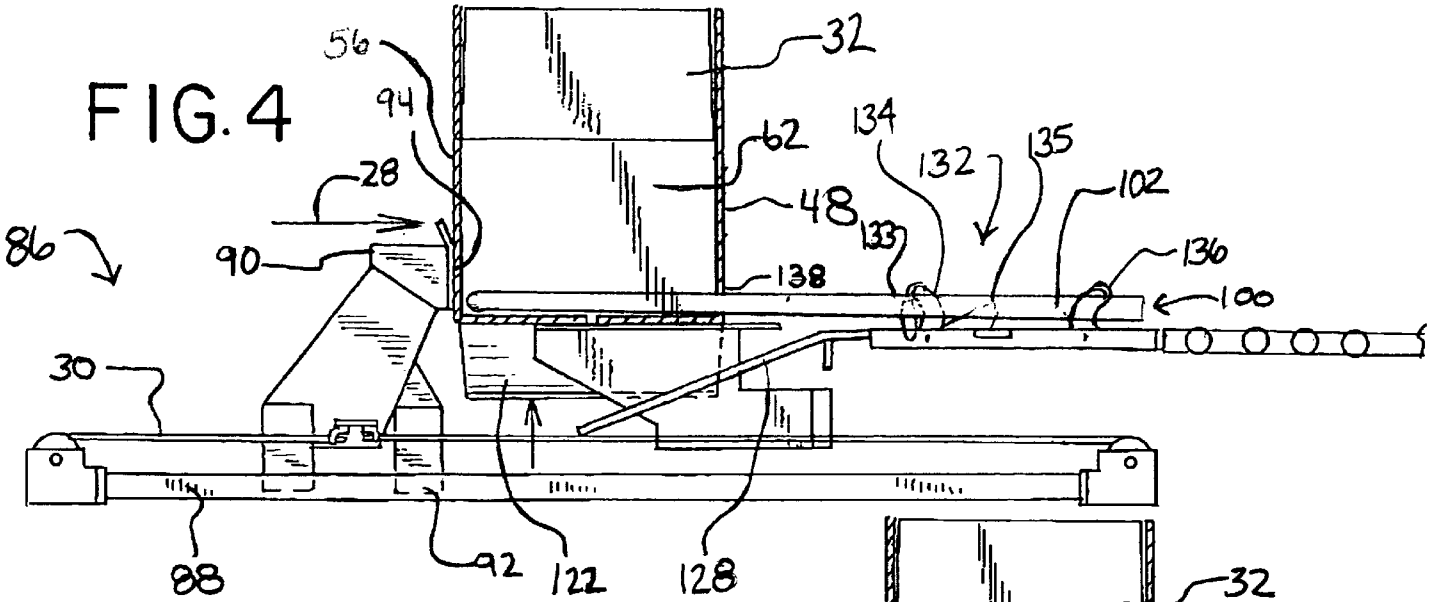
FIG. 4 is a fragmentary side elevational view of the machine of FIG. 1.

FIGS. 4 and 5 depict the horizontal blank mover assembly 86, which contains a slide 88 coupled to the pneumatic cable cylinder 30, and a case advancement mechanism, such as a sliding case pusher 90. As is well known in the art, the horizontal blank mover assembly 86 is conventional and commonly known to one of ordinary skill in the art. For example, a suitable horizontal blank mover assembly 86 found in the Little David® Model CF-40T case former manufactured by Loveshaw of South Canaan, Pa. In the preferred embodiment, the case pusher 90 is mounted to a sliding carriage 92, which in turn is mounted to both the pneumatic cable cylinder 30 and the slide 88. The case pusher 90 has a front face 94 that is vertically aligned with the vertical blank mover 24. Therefore, the front face 94 contacts the lagging case face 56 of the blank 14 when the blank is lowered to the opening and forming apparatus 16. It is preferred that the length of the pneumatic cable cylinder 30 corresponds to the length of the slide 88.

A valve (not shown) under the direction of a programmable logic controller (PLC) (not shown) activates the cable cylinder 30 once the minor flap folders 64, 66 have closed the minor flaps 84. When activated, the movement of the cable cylinder 30 causes the sliding case pusher 90 to travel linearly in the second direction 28, which consequently pushes the partially opened case in the second direction 28, into a side rail assembly 100. The side rail assembly 100 preferably contains a first side rail 102 and a second side rail (not shown) for maintaining orientation of the case during the remainder of assembly by exerting an equal force on either side, both the first case side 50 and the second case side 54. An advantage of the side rail assembly 100 is that it also preferably contains a clamping arm 106 (shown schematically) to adjust the width to the side rails 102 to accommodate cases of different sizes.

As the blank 14, which is now referred to as the case 20, is pushed in the second direction 28, a pair of major flaps 122 are closed by a major flap folding apparatus 126, made up of first and second major flap folders 128. In the preferred embodiment, the first and second major flap folders 128 are stationary upwardly and forwardly converging rods which progressively engage and fold the major flaps 122 as the opened case 20 is pushed in the second direction 28. As these major flaps 122 are folded over the already folded minor flaps 84, a center line 130 (best seen in FIG. 3) is defined by the junction between these two major flaps.

Progressing in the second direction 28, a case sealing apparatus, designated generally at 132, operates to seal the now closed major flaps 122. In the preferred embodiment, the case sealing apparatus 132 includes a standard case sealing apparatus known to one of ordinary skill in the art. For example, the commercially available case forming machine, Little David® Model CF-40T, utilizes a suitable case sealing apparatus. The present case sealing apparatus 132 includes a roll of adhesive tape 133 and first and second guide rollers 134, 136, which are coupled to one another.

As the case 20 progresses in the second direction 28, the roll of adhesive tape 133 having an exposed strip of adhesive is positioned immediately prior to the first guide roller 134. This exposed strip contacts and adheres to the case 20 at a lower portion 138 of the leading case face 48, which is aligned with the center line 130 at the junction of the folded major flaps 122. Subsequently, the case 20 contacts the first guide roller 134, the force of which causes the first guide roller and second guide roller 136 to retract, allowing the case 20 to progress over the rollers in the second direction 28. The progression of the case 20 having tape adhered thereto pulls additional tape from the roll of adhesive tape 133, and continues application of the adhesive tape down the center line 130, finishing at a lower portion of the lagging case face 56. Additionally, a spring mounted cutting apparatus 135 is mounted to the opening and forming apparatus 16 between the first and second guide rollers 134, 136. As the case 20 passes over this apparatus 135, the weight of the case depresses the apparatus. After the case 20 has cleared the apparatus 135, it springs upward and cuts the tape. An advantage of this sealing apparatus 132 is that the center line 130 is held in alignment by the side rail assembly 100, thus allowing precise sealing of the case 20 after opening and formation of the case.

The preferred embodiment of the instant invention is advantageous in that it provides a compact case forming machine having a minimal footprint on the factory floor on which it is installed. By vertically displacing the stacking apparatus 12 from the opening and forming apparatus 16, minimal floor space is consumed. Moreover, by orienting the blanks 14 in the stacking apparatus 12 in the first direction 22, and configuring the opening and forming apparatus 16 to operate in the second direction 28, the stacking apparatus and opening and forming apparatus can be stacked. This unique configuration also eliminates complicated movements in the transport of blanks 14 between the stacking apparatus 12 and the opening and forming apparatus 16. Lastly, by using pneumatic power to operate the machine 10 reduces the level of noise produced by the machine.

While a particular embodiment of the present case forming machine has been shown and described, it will be appreciated by those skilled in the art that changes and modifications may be made thereto without departing from the invention in its broader aspects and as set forth in the following claims.

What is claimed is:

1. A case forming machine for assembling erected cases from blanks comprising:

a stacking means configured for receiving and storing a supply of blanks in a first predetermined vertical orientation, case faces of the blanks each defining a generally vertical plane;

an opening and forming means for erecting the blanks and ejecting erected cases;

vertical suction transport means for suctioning one of the case faces and transporting the blanks vertically downward from said stacking means to said opening and forming means while maintaining said first predetermined generally vertically planar orientation of the case faces of the transported blanks; and said machine constructed and arranged so that said stacking means is configured for biasing the supply of blanks in a first direction, and said opening and forming means is configured so that the cases are ejected in a second direction to reduce floor space required by said machine.

2. The case forming machine as recited in claim 1, wherein said stacking means is vertically displaced from, and generally parallel to said opening and forming means.

3. The case forming machine as recited in claim 1, wherein said stacking means includes a vertically-oriented biasing member constructed and arranged so that each blank in the supply of blanks is vertically positioned within said stacking means.

4. The case forming machine as recited in claim 1, wherein said vertically-oriented biasing member exerts a force on the supply of blanks in said first direction.

5. The case forming machine as recited in claim 1, further including a vertical blank mover having at least one vacuum aim for vertical transport of the blanks from said stacking means to said opening and forming means.

6. The case forming machine as recited in claim 1, wherein said opening and forming means includes at least one vacuum arm.

7. The case forming machine as recited in claim 1, wherein said opening and forming means further includes a minor flap folding apparatus.

8. The case forming machine as recited in claim 1, wherein said minor flap folding apparatus includes a first arm and a second arm, said first arm applying force to a first minor flap on a blank and said second arm applying force to a second minor flap on a blank.

9. The case forming machine as recited in claim 1, wherein said opening and forming means further comprises a sliding case pusher coupled to a cable cylinder for advancing a case in said second direction.

10. The case forming machine as recited in claim 1, wherein said opening and forming means further comprises a major flap folding apparatus.

11. The case forming machine as recited in claim 10, wherein said major flap folding apparatus further includes upwardly and forwardly converging first and second rods.

12. The case forming machine of claim 1 wherein said predetermined orientation of the blanks comprises a vertical orientation with a plurality of upper blank flaps facing an upward direction.

13. The case forming machine of claim 1 wherein the blanks are both stacked within said stacking means and are received by said opening and forming means in said predetermined orientation.

14. The case forming machine of claim 1 wherein said vertical transport means comprises a vertical blank mover having at least one vacuum arm for adhering to a predetermined surface of the blanks to maintain the blanks in said predetermined orientation while transporting the blanks to said opening and forming means.

15. A case forming machine for assembling erected cases from blanks of the type having four sides, four top flaps and four bottom flaps, wherein the four top flaps and four bottom flaps comprise a top end and a bottom end of the cases when erected, said machine comprising:

a generally horizontal stacking apparatus configured for stacking the blanks in a first predetermined vertical orientation so that case faces of the blanks each define a vertical plane and for biasing the blanks in a first direction;

a generally horizontal case opening and forming apparatus that is generally parallel to said stacking apparatus and configured to receive the blanks having said predetermined orientation and so that the cases are ejected in a second direction;

a vertical blank mover suctioning one of the case faces during transferring of each of the blanks vertically downward and being generally vertically disposed between said stacking apparatus and said horizontal case opening and forming apparatus; and said vertical blank mover being configured to transport the blanks vertically downward between said stacking apparatus and said horizontal case opening and forming apparatus while maintaining the case faces of the transported blanks in said first predetermined, vertically planar orientation.

16. The machine of claim 15 herein said machine is configured to stack the blanks within said stacking means in a vertical orientation, with the top flaps of the blanks facing an upward direction.

17. The case forming machine of claim 15 wherein said opening and forming apparatus further includes a flap sealing mechanism.

* * * * *